US006431284B1

(12) United States Patent
Finn et al.

(10) Patent No.: US 6,431,284 B1
(45) Date of Patent: Aug. 13, 2002

(54) GIMBALED TABLE RISER SUPPORT SYSTEM

(75) Inventors: Lyle D. Finn, Sugar Land; Himanshu Gupta, Houston, both of TX (US)

(73) Assignee: CSO Aker Maritime, Inc., Houston, TX (US)

( * ) Notice: Subject to any disclaimer, the term of this patent is extended or adjusted under 35 U.S.C. 154(b) by 0 days.

(21) Appl. No.: 09/677,814

(22) Filed: Oct. 3, 2000

(51) Int. Cl.[7] ..... E21B 43/017

(52) U.S. Cl. ..... 166/350; 166/355; 166/382; 405/224.3; 405/224.4

(58) Field of Search ..... 166/366–368, 166/350, 355, 358, 382; 405/223.1, 224, 224.2–224.4

(56) References Cited

U.S. PATENT DOCUMENTS

| | | | | |
|---|---|---|---|---|
| 4,215,950 | A | * | 8/1980 | Stevenson |
| RE30,590 | E | | 4/1981 | Blenkarn |
| 4,379,657 | A | * | 4/1983 | Widiner et al. |
| 4,733,991 | A | * | 3/1988 | Myers |
| 4,850,744 | A | * | 7/1989 | Petty et al. |
| 4,913,238 | A | * | 4/1990 | Danazcko et al. |
| 4,966,495 | A | * | 10/1990 | Goldman |
| 4,995,762 | A | * | 2/1991 | Goldman |
| 5,330,293 | A | * | 7/1994 | White et al. |
| 5,427,180 | A | | 6/1995 | Leite et al. |
| 5,439,321 | A | * | 8/1995 | Hunter |

FOREIGN PATENT DOCUMENTS

| | | |
|---|---|---|
| EP | 0 390 728 A | 10/1990 |
| WO | WO 99/50136 | 10/1999 |
| WO | WO 01/16458 A1 | 3/2001 |

* cited by examiner

*Primary Examiner*—Roger Schoeppel
(74) *Attorney, Agent, or Firm*—Arnold & Associates; Gordon T. Arnold

(57) ABSTRACT

For a spar type floating platform having risers passing vertically through the center well of a spar hull, there is provided apparatus for supporting the risers from a gimbaled table supported above the top of the spar hull. The table flexibly is supported by a plurality of non-linear springs attached to the top of the spar hull. The non-linear springs compliantly constrain the table rotationally so that the table is allowed a limited degree of rotational movement with respect to the spar hull in response to wind and current induced environmental loads. Larger capacity non-linear springs are located near the center of the table for supporting the majority of the riser tension, and smaller capacity non-linear springs are located near the perimeter of the table for controlling the rotational stiffness of the table. The riser support table comprises a grid of interconnected beams having openings therebetween through which the risers pass. The non-linear springs may take the form of elastomeric load pads or hydraulic cylinders, or a combination of both. The upper ends of the risers are supported from the table by riser tensioning hydraulic cylinders that may be individually actuated to adjust the tension in and length of the risers. Elastomeric flex units or ball-in-socket devices are disposed between the riser tensioning hydraulic cylinders and the table to permit rotational movement between the each riser and the table.

32 Claims, 7 Drawing Sheets

GIMBALED TABLE RISER SUPPORT SYSTEM

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention relates to offshore mineral drilling and production platforms of the spar type and, more particularly, is concerned with apparatus for supporting drilling and production risers from a gimbaled table supported above the top of the spar hull wherein the table is compliantly constrained, but allowed limited rotational movement with respect to the spar hull.

2. Description of the Prior Art

Drilling and production operations for the exploration and production of offshore minerals require a floating platform that is as stable as possible against environmental forces, even in severe weather conditions. Among the six degrees of freedom of a floating platform, the most troublesome to drilling and production operations are the pitch, heave, and roll motions.

Present spar type floating platforms typically have drilling and production risers that are supported by means of buoyancy cans attached to each of the individual risers. As the water depth in which a platform will be used increases, the diameter and length of the buoyancy cans must be increased to support the in-water weight of the risers and their contents. Larger diameter buoyancy cans require larger spar center well sizes, which in turn increases the spar hull diameter. Increasing the spar hull diameter and size in turn increases the hydrodynamic environmental loads acting on the spar. A larger size mooring system is then required to withstand the increased environmental loads. The total riser buoyancy can system for deep water spar platforms can become very long and heavy, significantly increasing the fabrication and installation costs.

With present spar platforms having a buoyancy can riser support system, as the spar hull displaces laterally in response to environmental loads, the risers undergo a considerable amount of downward motion, or pull-down, with respect to the spar hull. This amount of riser pull-down increases as the water depth and riser length increases, and requires longer jumper hoses, large clear vertical heights between the top of the hull and the drilling deck, and expensive, large stroke keel joints.

Consequently, a need exists for improved apparatus for supporting drilling and production risers from a spar type floating platform. Preferably, such an improved apparatus will eliminate the need for riser buoyancy cans. It will preferably also reduce the amount of riser pull-down relative to the spar hull as the spar pitches and displaces in response to environmental forces. Such an improved riser support apparatus will also preferably reduce the amount of fixed ballast required, reduce the need for, or length of, riser jumper hoses, and reduce the size and diameter of the spar hull. It will also preferably be less expensive to build, install, and maintain than individual riser buoyancy can systems in present use.

BRIEF SUMMARY OF THE INVENTION

The present invention provides a riser support and tensioning apparatus and method that satisfies the aforementioned needs. According to one aspect of the invention, for a spar type floating platform having risers passing vertically through the center well of a spar hull, the spar hull having a top surface, apparatus is provided for supporting the risers from the spar hull. The apparatus comprises a table disposed above the spar hull top surface and a plurality of non-linear springs associated with the table and the spar hull for permitting rotational movement between the table and the spar hull. The apparatus also comprises means for attaching the upper ends of the risers to the table.

According to another aspect of the invention, for a spar type floating platform having risers passing vertically through the center well of a spar hull, the spar hull having a top surface, apparatus is provided for supporting the risers from the spar hull. The apparatus comprises a table disposed above the spar hull top surface. The table comprises a grid having openings therethrough. The risers pass through respective openings in the table grid. For each riser, at least one riser tensioning hydraulic cylinder is provided, having one end attached to the riser and the opposite end attached to the table, such that the tension in and length of the riser may be adjusted by operation of the riser tensioning hydraulic cylinder. A plurality of elastomeric load pads are disposed between the table and the spar hull for permitting rotational movement therebetween. Larger capacity load pads are located near the center of the table for supporting the majority of the riser tension, and smaller capacity load pads are located near the perimeter of the table for controlling the rotational stiffness of the spar hull.

According to a still farther aspect of the invention, for a spar type floating platform having risers passing vertically through the center well of a spar hull, the spar hull having a top surface, apparatus is provided for supporting the risers from the spar hull. The apparatus comprises a table disposed above the spar hull top surface. The table comprises a grid having openings therethrough. The risers pass through respective openings in the table grid. For each riser, at least one riser tensioning hydraulic cylinder is provided, having one end attached to the riser and the opposite end attached to the table, such that the tension in and length of the riser may be adjusted by operation of the riser tensioning hydraulic cylinder. A plurality of table supporting hydraulic cylinders is disposed between the table and the spar hull for permitting rotational movement therebetween. Each table supporting hydraulic cylinder has a first end pivotally attached to the table and a second end pivotally attached to the spar hull. At least one lateral support shaft has an upper end pivotally attached to the table and a lower end. For each lateral support shaft, at least one guide is attached to the spar hull for slidably receiving the lower end of the lateral support shaft.

According to another aspect of the invention, for a spar type floating platform having risers passing vertically through the center well of a spar hull, the spar hull having a top surface, apparatus is provided for supporting the risers from the spar hull. The apparatus comprises a table disposed above the spar hull top surface. The table comprises a grid having openings therethrough. The risers pass through respective openings in the table grid. For each riser, at least one riser tensioning hydraulic cylinder is provided, having one end attached to the riser and the opposite end attached to the table, such that the tension in and length of the riser may be adjusted by operation of the riser tensioning hydraulic cylinder. A plurality of pedestals is provided, each pedestal having a lower end attached to the spar hull and an upper end higher than the table for hanging the table therefrom. For each pedestal, at least one non-linear spring is associated with the table, the pedestal, and the spar hull for permitting rotational movement between the table and the spar hull.

According to still another aspect of the invention, for a spar type floating platform having risers passing vertically through the center well of a spar hull, apparatus is provided for suspending and tensioning a riser from a surface associated with the spar hull, and for permitting limited rotational movement between the riser and the surface. The apparatus comprises a hydraulic cylinder having one end attached to the riser and the other end attached to the surface. The tension in the riser may be adjusted by operation of the hydraulic cylinder. Means is provided for permitting rotational movement between the riser and the surface.

According to still another aspect of the invention, a method is provided for supporting a riser at a floating spar hull, the spar hull having a top surface. The method comprises the step of connecting a table to the spar hull, wherein the table has a limited range of rotational movement with respect to the spar hull top surface in response to environmental forces acting on the spar hull. The method further comprises the steps of suspending the riser from the table and of tensioning the riser.

BRIEF DESCRIPTION OF THE SEVERAL VIEWS OF THE DRAWING

For a more complete understanding of the invention, and the advantages thereof, reference is now mad to the following detailed description of the invention taken in conjunction with the accompanying drawings, in which.

DETAILED DESCRIPTION OF THE INVENTION

Figures 1, 4:
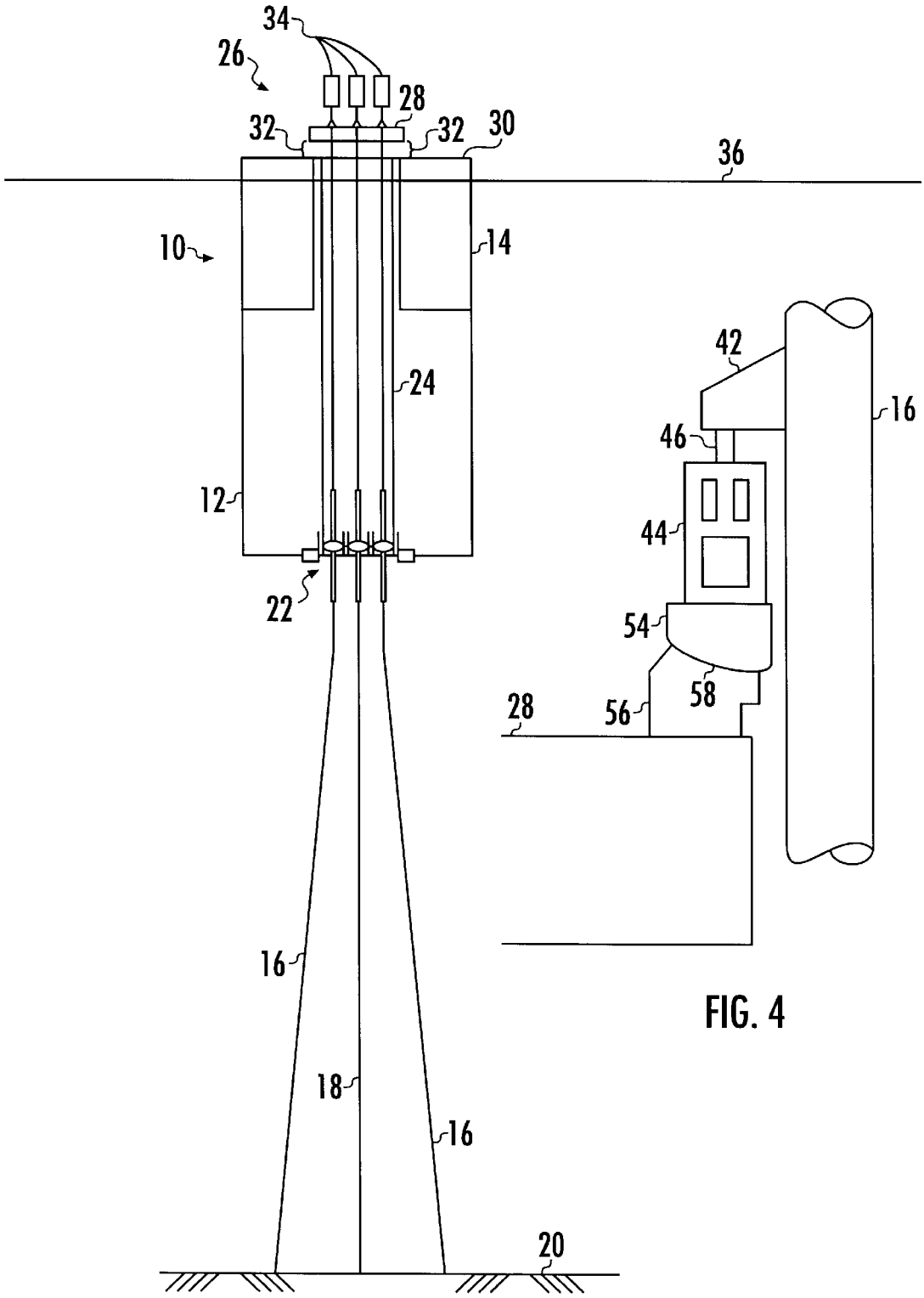
FIG. 1 is a schematic, side elevation view in cross-section of a spar type floating platform having a riser support apparatus of the present invention.
FIG. 4 illustrates an alternative, ball-in-socket device that may be used in the apparatus of FIG. 3.

Referring now to the drawings, and more particularly to FIG. 1, there is schematically shown a side elevation view of a spar type floating platform, generally designated 10, employing a riser support apparatus of the present invention. Spar platform 10 includes spar hull 12 having buoyancy tanks 14 at its upper end. Production risers 16 and drilling riser 18 extend from wells (not shown) on the sea floor 20 up through keel joint 22 at the lower end of spar hull 12. The risers 16 and 18 extend up through the center well 24 of spar hull 12 and are tied at their upper ends to riser support apparatus 26. Riser support apparatus 26 includes riser support table 28, which is compliantly supported above top surface 30 of spar hull 12 by non-linear springs 32. Trees 34 are attached to the upper ends of risers 16 and 18. Spar hull 12 floats at and extends slightly above water surface 36.

Figure 2:
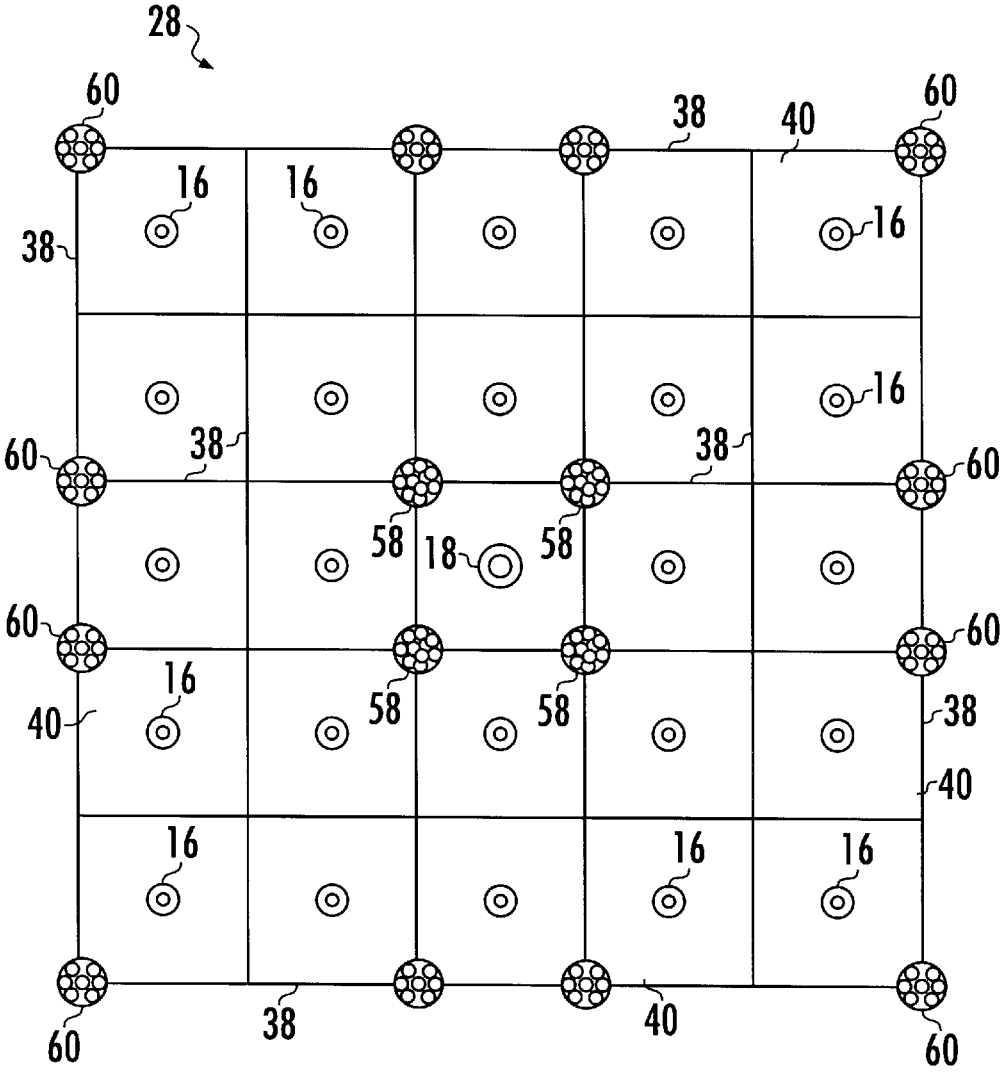
FIG. 2 is a plan view of the riser support table of the present invention.

Referring now to FIG. 2, there is shown a plan view of riser support table 28. Table 28 is made up of beams 38 interconnected to form a grid. Production risers 16 and drilling riser 18 pass through respective openings 40 of the grid of table 28.

Figure 3:
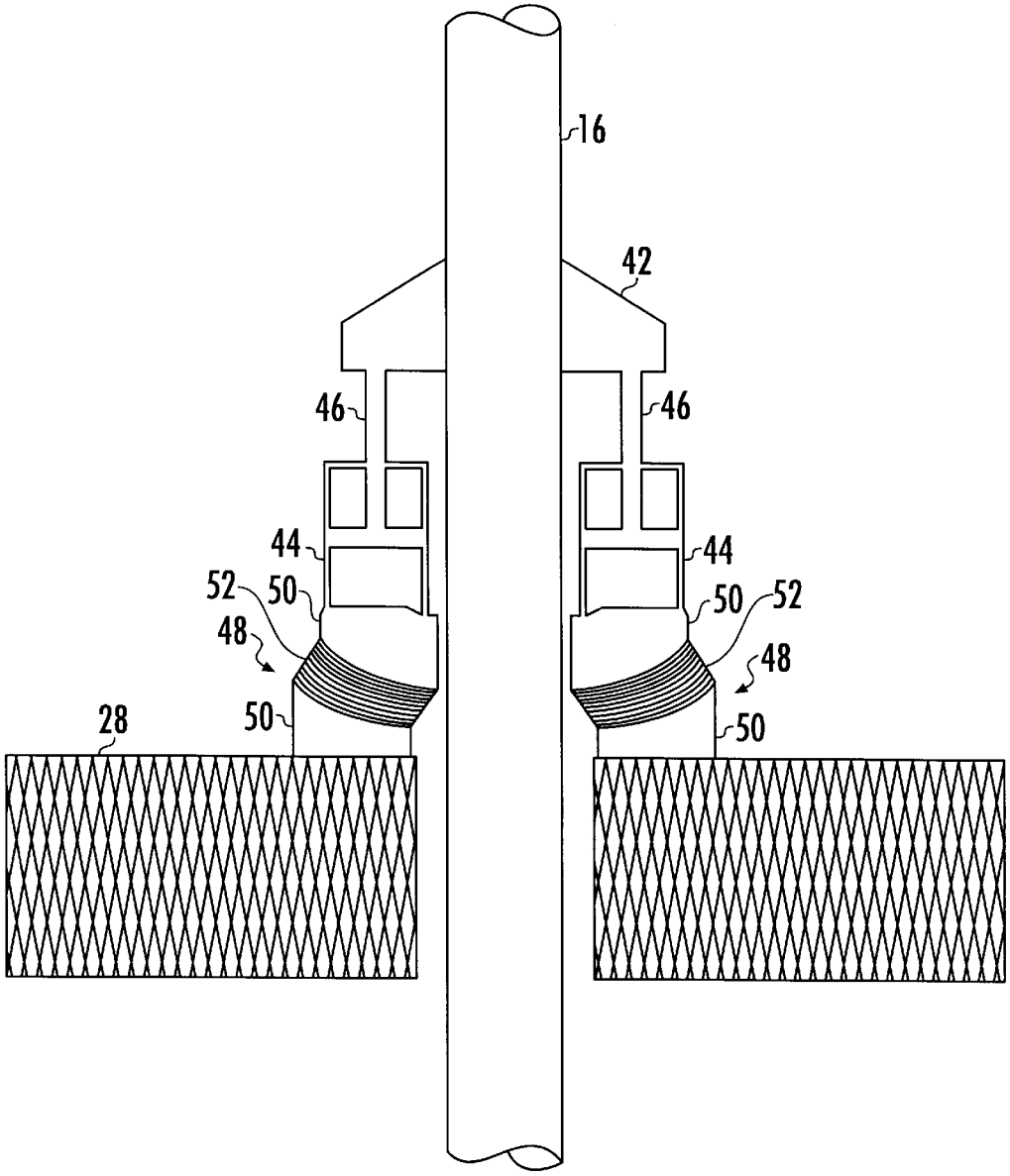
FIG. 3 is a side, cross-sectional view of an apparatus of the present invention for supporting and tensioning the risers.

FIG. 3 illustrates an apparatus of the present invention for supporting and tensioning risers 16 and 18 from riser support table 28. As seen in FIG. 3, riser support bracket 42 is clamped or welded to riser 16 above table 28. Riser tensioning hydraulic cylinders 44 located below riser support bracket 42 have pistons 46 attached to riser support bracket 42. The bottoms of hydraulic cylinders 44 are attached to table 28 by elastomeric flex units 48. Elastomeric flex units 48 permit relative rotation between hydraulic cylinders 44 and table 28, and thus between riser 16 and table 28. Some degree of rotation between risers 16 and 18 and table 28 is necessary because risers 16 and 18 will tend to remain parallel to the axis of spar hull 12, or tilt with spar hull 12, as table 28 rotates relative to spar hull 12. Elastomeric flex units include rigid portions 50 and flexible portions 52 between rigid portions 50. Rigid portions 50 are preferably made of steel, and flexible portions 52 are preferably made of an elastomeric material.

After risers 16 and 18 are installed on table 28, hydraulic cylinders 44 may be operated to adjust the tension and lengths of the risers to provide the correct fixed ballast to the spar hull from the riser weight, and to compensate for temperature changes in the risers caused by the produced fluid and the temperature of the surrounding risers.

FIG. 4 illustrates an alternative device to elastomeric flex units 48 for permitting relative rotation between hydraulic cylinders 44 and table 28. In this embodiment, a segment of a ball 54 is attached to the bottom of hydraulic cylinder 44, and a mating cup 56 is attached to table 28. Spherically shaped surface 58 of cup 56 slidingly engages the spherical surface of ball segment 54, and permits relative rotation between hydraulic cylinder 44 and table 28, and thus between riser 16 and table 28.

Figure 5:
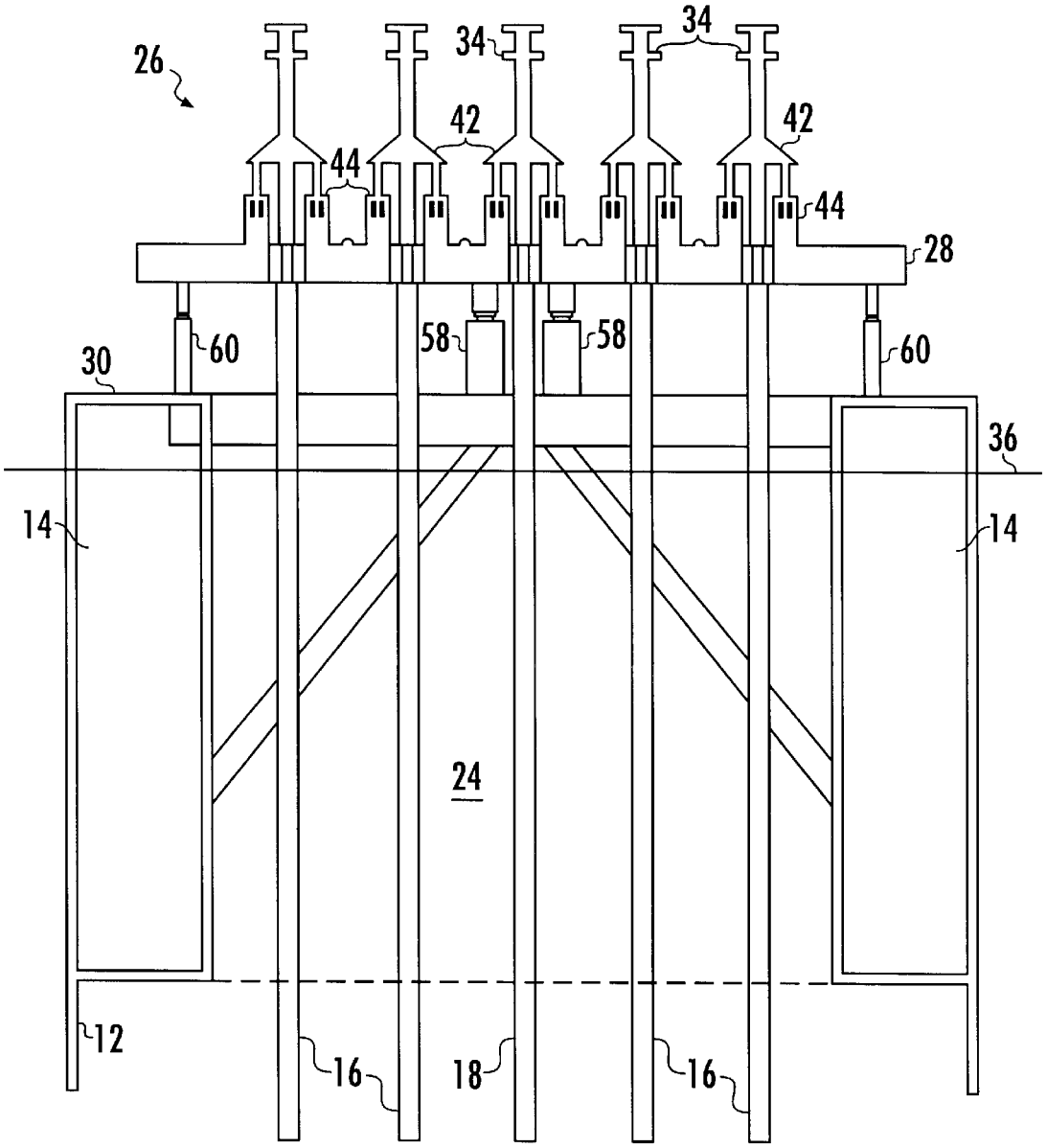
FIG. 5 is a schematic, side elevation view in cross-section of the upper portion of the spar hull and an embodiment of the riser support apparatus of the invention utilizing elastomeric load pads.

FIG. 5 illustrates a first embodiment of a riser support apparatus of the present invention. In this embodiment, elastomeric load pads 58 and 60 function as non-linear springs 32 for compliantly supporting table 28 above top surface 30 of spar hull 12, as described with reference to FIG. 1. Elastomeric load pads 58 and 60 are sized to be strong enough to support the tension in all of the risers 16 and 18 and with a spring rate that keeps the heave period of the spar platform and the riser support system larger than the dominant wave period. Elastomeric load pads 58 and 60 are placed laterally around table 28 in such a manner as to allow table 28 to rotate to a limited degree relative to spar hull top surface 30 as spar hull 12 pitches in response to environmental forces. This relative rotation is necessary to prevent large axial tension and compression fluctuations in risers 16 near the outer perimeter of table 28. Risers 16 are axially secured at their upper ends to table 28, and at their lower ends to the sea floor. Therefore, if table 28 were rigidly fixed in its position above spar hull top surface 30 without any means for relative rotation therebetween, a tilt of spar hull 12 from its normally vertical position would induce large compressive loads in the risers 16 on the side of spar hull 12 tilted down. This large compressive load would overstress and eventually buckle these risers. Similarly, the risers 16 on the opposite side of spar hull 12 would experience large tensile loads. The large variations in axial tension and compression in risers 16 would result in unacceptable fatigue damage to risers 16 over the lifetime of the installation. The relative rotation between table 28 and spar hull 12 permitted by elastomeric load pads 58 and 60 allows the upper ends of risers 16 to "float" with respect to upper surface 30 of spar hull 12, and thus prevents large axial tension and compression fluctuations in risers 16 resulting from environmentally induced pitching of spar hull 12.

As seen most clearly in FIG. 2, large capacity elastomeric load pads 58 are located near the center of table 28 for supporting a large portion of the riser tension. Smaller capacity elastomeric load pads 60 are located near the perimeter of table 28 for controlling the rotational stiffness of table 28 with respect to spar hull 12. The combined axial stiffness of all the risers 16 and 18 installed on the spar platform varies in direct proportion to the number of risers installed. When fewer risers are installed, their combined axial stiffness is reduced proportionately. Therefore, the vertical stiffness of the riser support apparatus does not normally require adjustment as risers 16 and 18 are added to, or removed from, table 28. Furthermore, regardless of the number of risers installed on table 28, the heave period of the spar platform and riser support system will be greater than the dominant wave period if the appropriate spring rate is chosen for elastomeric load pads 58 and 60.

As additional risers are suspended from table 28, the rotational stiffness of the riser support system may be increased by inserting additional smaller capacity elastomeric load pads 60 around the perimeter of table 28. Alternatively, variable stiffness elastomeric load pads may be used for load pads 60. These commercially available load pads have an interior, sealed air chamber that can be pressurized or depressurized as needed to adjust their stiffness.

Figure 6:
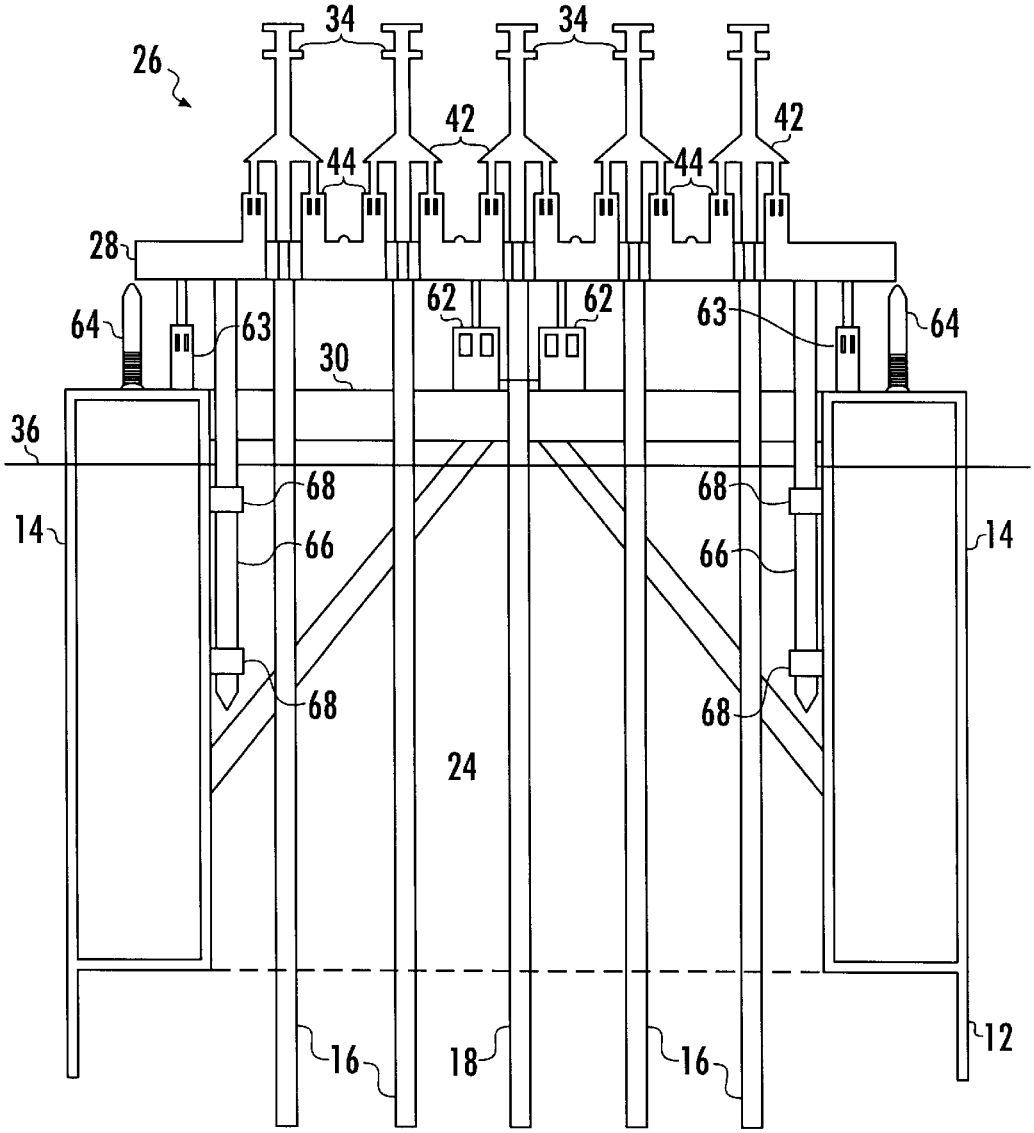
FIG. 6 is a schematic, side elevation view in cross-section of the upper portion of the spar hull illustrating an alternative embodiment of the invention utilizing table supporting hydraulic cylinders.

FIG. 6 illustrates an alternative embodiment of a riser support apparatus of the present invention. In this embodiment, table supporting hydraulic cylinders 62 and 63 function as non-linear springs 32 for compliantly supporting table 28 above top surface 30 of spar hull 12 as described with reference to FIG. 1. Large capacity hydraulic cylinders 62 are located near the center of table 28 for supporting a large portion of the riser tension. Smaller capacity hydraulic cylinders 63 are located near the perimeter of table 28 for controlling the rotational stiffness of table 28 with respect to spar hull 12. In order to permit table 28 to rotate about both horizontal axes with respect to spar hull 12, the upper ends of hydraulic cylinders 62 and 63 are pivotally attached to table 28, and the lower ends are pivotally attached to spar hull 12.

Air-over-oil accumulators 64 are hydraulically connected to smaller capacity hydraulic cylinders 63 for providing them with an adjustable spring rate. For a stiff spring rate, a relatively small amount of air should be maintained in accumulators 64. The use of hydraulic cylinders 63 with air-over-oil accumulators 64 provides greater operational flexibility than the riser support apparatus of FIG. 5. Both the tension force and the stiffness of hydraulic cylinders 63 can easily be adjusted over time by simply increasing or decreasing the air pressure in accumulators 64.

Because table supporting hydraulic cylinders 62 and 63 operate in compression and are hinged at their opposite ends, table 28 must be laterally supported with hydraulic cylinders 62 and 63 in their upright position to prevent table 28 and hydraulic cylinders 62 and 63 from folding down flat against upper surface 30 of spar hull 12. Lateral support shafts 66 provide the required lateral stability to the riser support apparatus of FIG. 6. The upper ends of lateral support shafts 66 are pivotally attached to table 28 so as to permit relative rotation between table 28 and spar hull 12. The lower ends of shafts 66 are loosely fitted within guides 68 attached to spar hull 12. Lateral support shafts 66 slide axially within guides 66 as table 28 tilts with respect to upper surface 30 of spar hull 12 in response to environmental loads. For a spar hull 12 having a center well 24 of square cross-sectional shape, four lateral support shafts 66 are preferably used, one being located near each of the four corners of center well 24.

Figure 7:
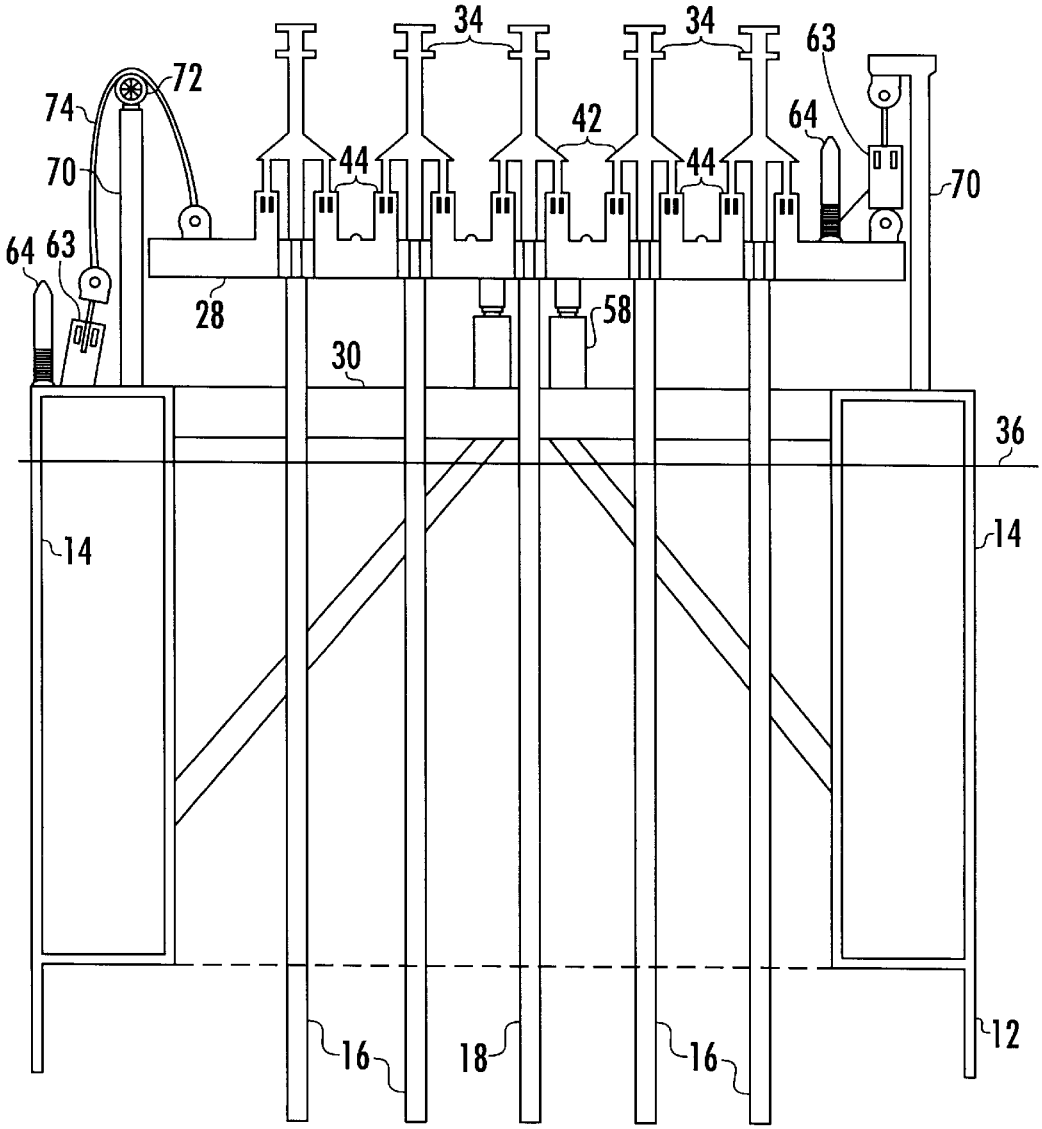
FIG. 7 is a schematic, side elevation view in cross-section of the upper portion of the spar hull illustrating an alternative embodiment of the invention wherein the riser support table is hanging from pedestals attached to the spar hull.

FIG. 7 illustrates another alternative embodiment of a riser support apparatus of the present invention. In this embodiment, table 28 is partially supported from the bottom only by elastomeric load cells 58 located near the center of table 28. To provide additional vertical support and the necessary lateral stability, table 28 is hung from pedestals 70. The lower ends of pedestals 70 are rigidly attached to spar hull 12, and their upper ends are higher than table 28 so that table 28 may be hung therefrom. Table supporting hydraulic cylinders 63 are used to provide limited rotational movement to table 28. With this arrangement, table 28 is naturally stable because it is suspended from an upper support structure.

FIG. 7 illustrates two ways in which table 28 may be hung from pedestals 70 by hydraulic cylinders 63. The first way is illustrated at the right end of table 28. Here, hydraulic cylinder 63 has an upper end pivotally connected to the top of pedestal 70 and a lower end pivotally connected to table 28, so that hydraulic cylinder 63 directly supports table 28 from pedestal 70. Air-over-oil accumulator 64 is placed on table 28 near, and is hydraulically connected to, hydraulic cylinder 63 to provide it an adjustable spring rate as described above with reference to hydraulic cylinders 63 in FIG. 6.

The second way in which table 28 may be hung from pedestals 70 is illustrated at the left end of table 28. Here, pulley 72 is pivotally mounted near the top of pedestal 70. Cable 74 passes over the top of pulley 72 and has one end attached to table 28 and the opposite end attached to the upper end of hydraulic cylinder 63. The lower end of hydraulic cylinder 63 is attached to spar hull 12 so that the tension in cable 74 is borne by hydraulic cylinder 63. Air-over-oil accumulator 64 is placed on spar hull 12 near, and hydraulically connected to, hydraulic cylinder 63 as described above. Although not illustrated, hydraulic cylinder 63 could instead be mounted on table 28 and connected to the opposite or right end of cable 74. In that case, the left end of cable 74 opposite hydraulic cylinder 63 would be connected directly to spar hull 12.

Figure 8:
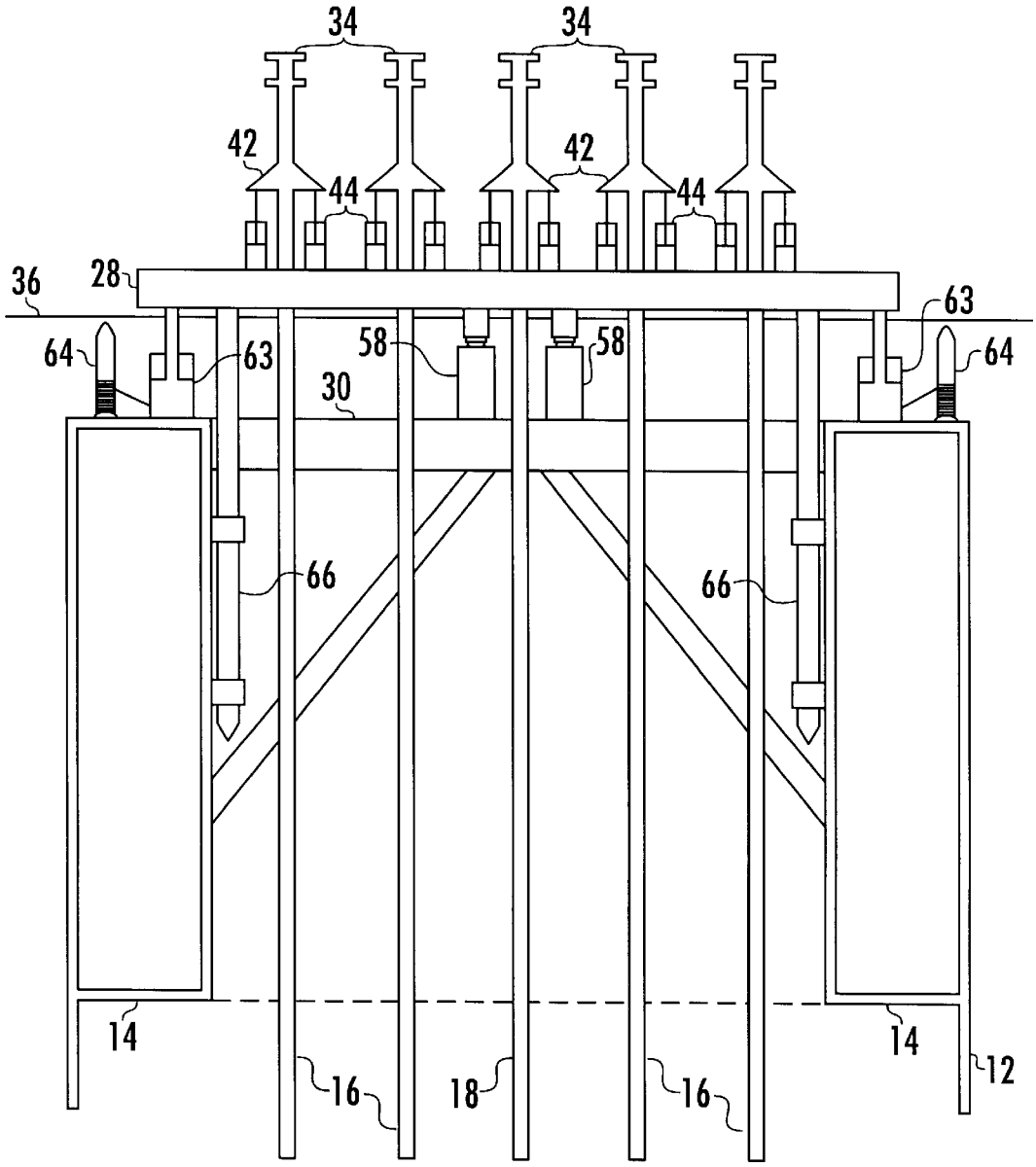
FIG. 8 illustrates an embodiment of the invention utilizing both elastomeric load pads and table supporting hydraulic cylinders.

FIG. 8 illustrates a combination of some of the above described alternative embodiments of the riser support apparatus of this invention. Such a combination of features may provide the most desirable system in terms of operational flexibility. Large, rather stiff elastomeric load pads 58 placed under and near the center of table 28 support the majority of the tension in risers 16 and 18. Four lateral support shafts 66 pivotally attached to table 28 and located near the corners of center well 24 of spar hull 12 provide the needed lateral stability to table 28. Smaller capacity table supporting hydraulic cylinders 63 located under and near the perimeter of table 28 provide the proper rotation stiffness. Depending on the direction of rotation of table 28, hydraulic cylinders 63 could act in either compression or tension. The tension and sniffiness of hydraulic cylinders 63 can be adjusted by adjusting the air pressure in accumulators 64 to keep the overall rotational stiffness of table 28 at the desired level over time as wells are drilled and additional production risers 16 are installed.

A coupled computer aided design analysis was performed to compare a number of variable design parameters of a spar floating platform having a riser support system of the present invention with those of a traditional spar platform having risers individually supported by buoyancy cans. The analysis was based on the following fixed design parameters for both types of spar platforms:

| Design Basis | |
|---|---|
| Water depth: | 4500 feet |
| Topside weight: | 39,000 tons |
| Topside VCG above hull top: | 80 feet |
| Wind sail area: | 68,000 square feet |
| Wind center of pressure: | 150 feet |
| Number of wells: | 20 |
| Well pattern: | 5 × 5 |
| Production risers: | |
| outer casing outer diameter: | 13.375 inches |
| outer casing thickness: | 0.48 inches |
| inner casing outer diameter: | 10.75 inches |
| inner casing thickness: | 0.797 inches |
| tubing outer diameter: | 5.5 inches |
| tubing thickness: | 0.415 inches |
| Outer casing design pressure: | 4000 psi |
| Inner casing design pressure: | 8500 psi |
| Tubing design pressure: | 8500 psi |
| Fluid weights under production: | |
| Outer casing: | 8.55 ppg |
| Inner casing: | 15.5 ppg |
| Tubing: | 5.5 ppg |
| Riser tree elevation: | 55 feet |
| Total riser weight at tree elevation: | 872 kips |
| Riser weight at keel: | 736 kips |
| Riser wet weight per foot: | 191 lb/ft. |
| Riser EA/L: | 325 kips/ft. |

The coupled design analysis resulted in the following design parameters for spar platforms having each type of riser support system:

| | Traditional spar with riser buoyancy cans | Spar with riser support system of invention |
|---|---|---|
| Spar center well | wet | wet |
| Center well size (feet) | 75 × 75 | 50 × 50 |
| Spar hull diameter (feet) | 158 | 150 |
| Draft (feet) | 650 | 650 |
| Hard tank depth (feet) | 255 | 245 |
| Freeboard (feet) | 55 | 55 |
| Truss height (feet) | 360 | 380 |
| Soft tank height (feet) | 35 | 25 |
| Hull steel weight (tons) | 29,937 | 29,200 |
| Fixed ballast (tons) | 36,668 | 21,844 |

-continued

| | Traditional spar with riser buoyancy cans | Spar with riser support system of invention |
|---|---|---|
| Riser tension supported (tons) | 0 | 14,160 |
| Variable ballast (tons) | 12,347 | 14,398 |
| Number of mooring lines | 16 | 16 |
| Mooring pattern | 4 × 4 | 4 × 4 |
| Pretension (kips) | 650 | 550 |
| Fairlead elevation (feet) | 255 | 245 |
| Upper chain | | |
| diameter (inches) | 5.875 | 5.875 |
| length (feet) | 250 | 250 |
| Wire | | |
| diameter (inches) | 5.375 | 5.125 |
| length (feet) | 6000 | 5500 |
| Lower chain | | |
| diameter (inches) | 5.875 | 5.875 |
| length (feet) | 200 | 200 |

There are several advantages attained by the use of the gimbaled table riser support system of the present invention with a spar type floating platform. First, the magnitude of spar pitch motions are reduced 10 to 25 percent from those of a traditionally designed spar with buoyancy cans. Second, because the gimbaled table supports the risers, the riser weight replaces fixed ballast in the spar hull. Therefore, the amount of fixed ballast required is greatly reduced by approximately 40 percent. Third, the need for buoyancy cans for supporting the risers is eliminated. This also eliminates released buoyancy can concerns and the need for buoyancy can guide structures. Fourth, riser pull-down relative to the spar hull is significantly reduced, which reduces jumper hose requirements. Fifth, a simplified keel joint design may be used. Sixth, the present invention permits easier drilling and production operations and easier access to trees and risers. Seventh, the riser tensioning system becomes more manageable and inspectable. Eighth, riser interference is essentially eliminated. Ninth, the spar hull diameter and center well size may be reduced. This in turn reduces the mooring line size requirement. Tenth, the smaller sea floor riser pattern reduces the amount of lateral offset of the spar platform. Eleventh, slip joint requirements are reduced, and requirements for drilling tensionsers and workover riser tensioning are eliminated. Twelfth, special workover buoyancy requirements are eliminated. Thirteenth, the smaller size center well permits reduced topside dimensions. Fourteenth, tensioning system redundancy is not required for each individual riser. Therefore, the need for an extra buoyancy chamber in each riser is eliminated. Finally, a riser support system of the present invention is less expensive to build, install, and maintain than the individual riser buoyancy can system in present use.

The gimbaled table riser support system and method of the present invention, and many of its intended advantages, will be understood from the foregoing description of example embodiments, and it will be apparent that, although the invention and its advantages have been described in detail, various changes, substitutions, and alterations may be made in the manner, procedure, and details thereof without departing from the spirit and scope of the invention, as defined by the appended claims, or sacrificing any of its material advantages, the form hereinbefore described being merely exemplary embodiments thereof.

What is claimed is:

1. For a spar type floating platform having risers passing vertically through the center well of a spar hull, the spar hull having a top surface, apparatus for supporting the risers from the spar hull, which comprises:

a table disposed above the spar hull top surface;

a plurality of non-linear springs associated with the table and the spar hull for permitting rotational movement between the table and the spar hull; and means for attaching the upper ends of the risers to the table.

2. The apparatus of claim 1, wherein the table comprises a grid having openings therethrough, and wherein the risers pass through respective openings in the table grid.

3. The apparatus of claim 2, wherein the means for attaching the upper ends of the risers to the table comprises, for each riser, at least one riser tensioning hydraulic cylinder having one end attached to the riser and the opposite end attached to the table, such that the tension in and length of the riser may be adjusted by operation of the riser tensioning hydraulic cylinder.

4. The apparatus of claim 3, further including an elastomeric flex unit disposed between the riser tensioning hydraulic cylinder and the table for permitting rotational movement between the cylinder and the table and thus between the riser and the table.

5. The apparatus of claim 3, further including a ball-in-socket device disposed between the riser tensioning hydraulic cylinder and the table for permitting rotational movement between the cylinder and the table and thus between the riser and the table.

6. The apparatus of claim 5, wherein the ball-in-socket device comprises a segment of a ball slidably disposed within a cup having a spherically shaped surface mating the ball segment.

7. The apparatus of claim 1, wherein at least one of the nonlinear springs associated with the table and the spar hull comprises an elastomeric load pad disposed between the table and the spar hull.

8. The apparatus of claim 1, wherein larger capacity non-linear springs are located between the table and the spar hull near the center of the table for supporting a large portion of the riser tension, and smaller capacity non-linear springs are located between the table and the spar hull near the perimeter of the table for controlling the rotational stiffness of the table.

9. The apparatus of claim 1, wherein at least one of the non-linear springs associated with the table and the spar hull comprises a table supporting hydraulic cylinder.

10. The apparatus of claim 9, further including an air-over-oil accumulator connected to the table supporting hydraulic cylinder for providing an adjustable spring rate to the hydraulic cylinder spring.

11. The apparatus of claim 9, wherein the table supporting hydraulic cylinder has a first end pivotally attached to the table and a second end pivotally attached to the spar hull.

12. The apparatus of claim 11, further including at least one lateral support shaft having an upper end pivotally attached to the table and a lower end slidably attached to the spar hull.

13. The apparatus of claim 12, further including at least one guide attached to the spar hull for slidably receiving the lower end of the lateral support shaft.

14. The apparatus of claim 12, wherein the center well of the spar hull is square in cross-sectional shape, and wherein a lateral support shaft is located near each of the comers of the center well.

15. The apparatus of claim 9, further including at least one pedestal having a lower end attached to the spar hull and an upper end higher than the table, and wherein the table supporting hydraulic cylinder has a first end connected to the table and a second end connected to the pedestal, whereby the table is hanging from the pedestal by the table supporting hydraulic cylinder.

16. The apparatus of claim 9, further including:

at least one pedestal having a lower end attached to the spar hull and an upper end higher than the table;

a pulley disposed near the top of the pedestal; and a cable passing over the pulley and having one end attached to the table supporting hydraulic cylinder and the opposite end attached to the table, whereby the table is hanging from the pedestal by the cable, and whereby the cable tension is borne by the table supporting hydraulic cylinder.

17. For a spar type floating platform having risers passing vertically through the center well of a spar hull, the spar hull having a top surface, apparatus for supporting the risers from the spar hull, which comprises:

a table disposed above the spar hull top surface, the table comprising a grid having openings therethrough, the risers passing through respective openings in the table grid;

for each riser, at least one riser tensioning hydraulic cylinder having one end attached to the riser and the opposite end attached to the table, such that the tension in and length of the riser may be adjusted by operation of the riser tensioning hydraulic cylinder; and a plurality of elastomeric load pads disposed between the table and the spar hull for permitting rotational movement therebetween, wherein larger capacity load pads are located near the center of the table for supporting a large portion of the riser tension, and smaller capacity load pads are located near the perimeter of the table for controlling the rotational stiffness of the spar hull.

18. The apparatus of claim 17, further including an elastomeric flex unit disposed between the riser tensioning hydraulic cylinder and the table for permitting rotational movement between the riser tensioning hydraulic cylinder and the table and thus between the riser and the table.

19. The apparatus of claim 17, further including a ball-in-socket device disposed between the riser tensioning hydraulic cylinder and the table for permitting rotational movement between the riser tensioning hydraulic cylinder and the table and thus between the riser and the table.

20. For a spar type floating platform having risers passing vertically through the center well of a spar hull, the spar hull having a top surface, apparatus for supporting the risers from the spar hull, which comprises:

a table disposed above the spar hull top surface, the table comprising a grid having openings therethrough, the risers passing through respective openings in the table grid;

for each riser, at least one riser tensioning hydraulic cylinder having one end attached to the riser and the opposite end attached to the table, such that the tension in and length of the riser may be adjusted by operation of the riser tensioning hydraulic cylinder; and a plurality of table supporting hydraulic cylinders disposed between the table and the spar hull for permitting rotational movement therebetween, each table supporting hydraulic cylinder having a first end pivotally attached to the table and a second end pivotally attached to the spar hull;

at least one lateral support shaft having an upper end pivotally attached to the table and a lower end; and for each lateral support shaft, at least one guide attached to the spar hull for slidably receiving the lower end of the lateral support shaft.

21. The apparatus of claim 20, further including an elastomeric flex unit disposed between the riser tensioning hydraulic cylinder and the table for permitting rotational movement between the riser tensioning hydraulic cylinder and the table and thus between the riser and the table.

22. The apparatus of claim 20, further including a ball-in-socket device disposed between the riser tensioning hydraulic cylinder and the table for permitting rotational movement between the riser tensioning hydraulic cylinder and the table and thus between the riser and the table.

23. The apparatus of claim 20, wherein larger capacity table supporting hydraulic cylinders are located near the center of the table for supporting a large portion of the riser tension, and smaller capacity table supporting hydraulic cylinders are located near the perimeter of the table for controlling the rotational stiffness of the table.

24. For a spar type floating platform having risers passing vertically through the center well of a spar hull, the spar hull having a top surface, apparatus for supporting the risers from the spar hull, which comprises:

a table disposed above the spar hull top surface, the table comprising a grid having openings therethrough, the risers passing through respective openings in the table grid;

for each riser, at least one riser tensioning hydraulic cylinder having one end attached to the riser and the opposite end attached to the table, such that the tension in and length of the riser may be adjusted by operation of the riser tensioning hydraulic cylinder; and a plurality of pedestals, each pedestal having a lower end attached to the spar hull and an upper end higher than the table for hanging the table therefrom; and for each pedestal, at least one non-linear spring associated with the table, the pedestal, and the spar hull for permitting rotational movement between the table and the spar hull.

25. The apparatus of claim 24, wherein at least one non-linear spring has a first end connected to the table and a second end connected to the pedestal, whereby the table is hanging from the pedestal by the non-linear spring.

26. The apparatus of claim 24, further including:

a pulley disposed near the top of the pedestal; and a cable passing over the pulley and having one end attached to the non-linear spring and the opposite end attached to one of the spar hull and the table, whereby the table is hanging from the pedestal by the cable, and whereby the cable tension is borne by the non-linear spring.

27. The apparatus of claim 24, further including a plurality of elastomeric load pads disposed between the table and the spar hull for assisting the pedestals in supporting the table and risers.

28. For a spar type floating platform having risers passing vertically through the center well of a spar hull, apparatus for suspending and tensioning a riser from a surface associated with the spar hull and for permitting limited rotational movement between the riser and the surface, which comprises:

a hydraulic cylinder having one end attached to the riser and the other end attached to the surface, such that the tension in the riser may be adjusted by operation of the hydraulic cylinder; and means for permitting rotational movement between the riser and the surface.

29. The apparatus of claim 28, wherein the means for permitting rotational movement between the riser and the surface comprises an elastomeric flex unit disposed between the hydraulic cylinder and the surface.

30. The apparatus of claim 28, wherein the means for permitting rotational movement between the riser and the surface comprises a ball-in-socket device disposed between the hydraulic cylinder and the surface.

31. A method for supporting a riser at a floating spar hull, the spar hull having a top surface, the method comprising:

connecting a table to the spar hull wherein the table has a limited range of rotational movement with respect to the spar hull top surface in response to environmental forces acting on the spar hull;

suspending the riser from the table; and tensioning the riser.

32. The method of claim 31, wherein the riser is tensioned by operating a hydraulic cylinder having one end attached to the riser and the opposite end attached to the table.

* * * * *